US009277803B2

(12) United States Patent
Clifton, Jr. et al.

(10) Patent No.: US 9,277,803 B2
(45) Date of Patent: Mar. 8, 2016

(54) ATTACHMENT AND LOCK FOR BATON IN A HOLSTER

(71) Applicants: Norman E. Clifton, Jr., Jacksonville, FL (US); James H. Radney, Jacksonville, FL (US)

(72) Inventors: Norman E. Clifton, Jr., Jacksonville, FL (US); James H. Radney, Jacksonville, FL (US)

(73) Assignee: Rogers Holster Co., LLC, Jacksonville, FL (US)

( * ) Notice: Subject to any disclaimer, the term of this patent is extended or adjusted under 35 U.S.C. 154(b) by 357 days.

(21) Appl. No.: 14/026,920

(22) Filed: Sep. 13, 2013

(65) Prior Publication Data

US 2015/0076192 A1 Mar. 19, 2015

(51) Int. Cl.
*A45F 5/02* (2006.01)

(52) U.S. Cl.
CPC ..... *A45F 5/021* (2013.01); *A45F 2200/0566* (2013.01)

(58) Field of Classification Search
CPC ..... F41C 33/0236; F41C 33/0245; F41C 33/0254; F41C 33/0272; F41C 33/0209; F41C 33/0227; F41C 33/0263; F41C 33/02; Y10S 224/912; Y10S 224/914; Y10S 224/931; A45F 5/021; A45F 2200/0591; A45F 2200/0566; Y10T 24/1391; Y10T 24/1376; Y10T 403/595; Y10T 403/591; Y10T 403/59; Y10T 403/592; F41H 9/10; F42B 39/22
USPC ..... 224/271, 196, 197, 195, 198, 200, 239, 224/238, 243, 242, 251, 911, 922, 245, 931, 224/912; 24/506, 505, 3.11; 379/445, 446
See application file for complete search history.

(56) References Cited

U.S. PATENT DOCUMENTS

| | | | | | |
|---|---|---|---|---|---|
| 5,699,943 | A * | 12/1997 | Schaefer | A45F 5/02 | 16/335 |
| 6,736,136 | B2 * | 5/2004 | Chen-Lieh | B63C 11/12 | 128/201.11 |
| 7,434,712 | B2 * | 10/2008 | Cook | F41C 33/0209 | 224/193 |
| 7,971,762 | B2 * | 7/2011 | Clifton, Jr. | A45F 5/02 | 224/197 |
| 8,499,986 | B2 * | 8/2013 | Knight | A45F 5/021 | 224/197 |
| 8,887,972 | B2 * | 11/2014 | Solomon | A45F 5/02 | 224/245 |
| 8,919,623 | B1 * | 12/2014 | Bergeron | A45F 5/02 | 224/148.4 |
| 2003/0085244 | A1 * | 5/2003 | Parsons | A45F 5/02 | 224/197 |
| 2014/0239023 | A1 * | 8/2014 | Tyybakinoja | A45F 5/021 | 224/197 |

* cited by examiner

*Primary Examiner* — Adam Waggenspack
*Assistant Examiner* — Matthew Theis
(74) *Attorney, Agent, or Firm* — Arthur G. Yeager

(57) ABSTRACT

Implement lock assembly for retaining batons, nightsticks, and other handheld devices within a holster. The assembly includes a base, a lock, and a release. Operation of the assembly is by a user applying pressure to the lock, pivotally moving the lock from an open position to a closed position. In the normal open position, an implement may be inserted or removed from the holster. In the closed position, the lock retains the implement within the holster. The lock may be opened by applying pressure to the release. The lock may engage and retain a baton along the length of the baton grip, allowing a user to adjust the position of the baton within the holster when the baton is retained by the lock.

19 Claims, 9 Drawing Sheets

ATTACHMENT AND LOCK FOR BATON IN A HOLSTER

CROSS-REFERENCE TO RELATED APPLICATION

This application claims the benefit of U.S. Design patent application 29/443,045, filed Jan. 11, 2013, and entitled "Attachment and Releasable Lock for Baton in a Holster," the entire contents of which are incorporated herein by reference.

FIELD OF THE DISCLOSURE

The present disclosure relates to holsters, and more particularly to attachments for holsters, including a lock assembly to retain an implement in the holster, and particularly a lock that may be actuated with one hand.

BACKGROUND

Law enforcement officers typically carry handheld objects on their belts using holsters. While many of the holster devices currently known provide access to useful implements like batons, nightsticks, and pepper spray, such devices are deficient in many respects.

Some holsters are open topped, enabling quick removal of the holstered implement by the wearer. Such a configuration may endanger both the wearer and third parties because the holstered implement may fall out of an open topped holster. Open topped holsters are susceptible to unauthorized implement removal by third parties. Additionally, known open topped holsters provide only one holstered position for an implement. For example, a baton or nightstick holster is configured to contain a fixed length of the nightstick within the holster, with the remainder of the nightstick protruding from the open top of the holster. This provides a graspable area of a fixed length, with no option of user adjustability of the graspable area.

Other known holsters include a detachable retaining flap. Generally, the flap is configured to wrap over at least a portion of the exposed top of an implement contained within the holster. The flap retains the implement via removable attachment of the flap to an outer portion of the body of the holster, thereby creating a retaining strap. The removable attachment is generally facilitated by a snap or button assembly. Such holsters reduce the risk of a holstered implement inadvertently falling out, however these devices make the drawing process more cumbersome and time consuming and only slightly reduce the risk of an unauthorized individual accessing a holstered implement. The wearer of such holsters must perform at least three distinct hand motions in order to draw and make ready a baton or other implement stored in the holster. First, the wearer must release the flap by decoupling the snap assembly. Second, the wearer must grasp the baton handle while avoiding gripping any part of the holster, such as the flap. Third, the wearer must remove the baton from the holster.

Because the flap may be removed by detaching the flap from the outer portion of the holster, a third party can easily disengage the snap or button assembly retaining the flap and remove the implement before the wearer reacts. Additionally, such holsters are difficult to operate without looking at the device during drawing and reholstering.

Furthermore, many prior art holsters are not ambidextrous. That is, they are specific to a right-handed or left-handed user.

Given the foregoing, what are needed are lock assemblies which securely retain holstered implements such as batons, nightsticks, pepper spray, and handcuffs. Additionally, assemblies are needed which reduce the risk of unauthorized implement removal by third parties and assemblies which reduce the hand motions necessary to release an implement and make it ready for use. Finally, implement assemblies are needed which may be operated by a left hand or a right hand and operated without the wearer looking at the assemblies and/or the locks thereof.

BRIEF SUMMARY OF THE INVENTION

This Summary is provided to introduce a selection of concepts in a simplified form that are further described below in the Detailed Description. This Summary is not intended to identify key features or essential features of the subject matter to be claimed, nor is it intended to be used to limit the scope of the subject matter to be claimed.

The present disclosure is directed to implement lock devices which facilitate securely retaining implements, such as batons, nightsticks, and pepper spray, within a holster. Devices in accordance with the present disclosure reduce risk of unauthorized implement removal via appropriate placement of a release actuator of a lock engagable with the implement. The placement of the release actuator enables a wearer to quickly and fluidly release the implement and make the same ready for use.

In some aspects of the present disclosure, the implement lock allows the wearer to adjust the position of the implement within its holster, while securing the implement. For example, an implement lock used to secure a baton allows the wearer to adjust the amount of handle exposed above the holster when the baton is secured by the implement lock, thereby enabling the wearer to put the baton grip in a more user friendly position.

In order to remove a baton from an implement lock assembly, the following actions may be taken. First, the user must grip the baton and, with the thumb or other finger of the gripping hand, the user actuates a release actuator, causing the lock to move from the closed position engaging the baton to the open position disengaging the baton. Second, the user must remove the baton from the holster.

Further features and advantages of the devices and systems disclosed herein, as well as the structure and operation of various aspects of the present disclosure, are described in detail below with reference to the accompanying figures.

BRIEF DESCRIPTION OF THE DRAWINGS

The features and advantages of the present disclosure will become more apparent from the Detailed Description set forth below when taken in conjunction with the drawings in which like reference numbers indicate identical or functionally similar elements.

DETAILED DESCRIPTION

The present disclosure is directed to an implement lock assembly which facilitates securely retaining handheld implements within a holster with reduced risk of unauthorized implement removal via appropriate placement of a release actuator. Such placement of the release actuator enables a wearer to quickly and readily release the implement and make the implement ready for use. In some aspects of the present disclosure, the implement lock assembly allows the wearer to adjust the relative exposed position of the implement with respect to the holster. For example, an implement lock used to secure a baton allows the wearer to adjust the amount of handle exposed above the holster when the baton is secured by the implement lock assembly, thereby enabling the wearer to place the baton grip in a more accessible and correct height position.

Implement lock assemblies in accordance may interface with a holster, sheath, or other device configured to transport and provide access to handheld implements. For the purposes of the present disclosure, "holster" refers to any such holster, sheath, container or other similar device.

For the purposes of the present disclosure, "implement" refers generally to any handheld device including, but not limited to: hammers, screwdrivers, wrenches, knives, multitools, other handheld construction implements, electronic devices, batons, nightsticks, and pepper spray.

Figure 1:
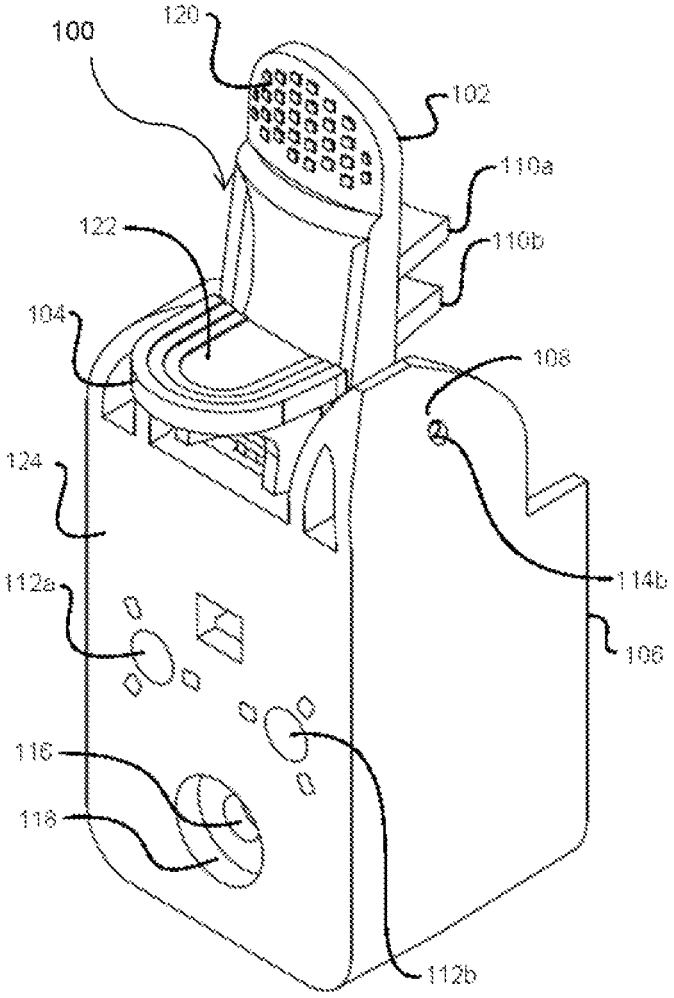
FIG. 1 is a rear perspective view of an implement lock assembly, in accordance with the present invention.

Referring now to FIG. 1 a rear perspective view of an implement lock assembly 100, in accordance with the present disclosure. Hereinafter, an "inner" portion of an element refers to a portion of an element closer to a user wearing the lock assembly 100. An "outer" portion of an element refers to a portion of an element which is farther away from a user wearing the implement lock assembly 100. Implement lock device 100 is preferably formed of typical holster body materials that are substantially rigid, but portions may be resilient or otherwise be injection molded using a variety of high grade polymers.

Implement lock assembly 100 includes three basic portions; a lock 102, a release 104, and a base 106. Lock 102 and base 106 are pivotally connected at lock fulcrum (shown generally at 108). Lock fulcrum may be a pin hinge comprising a pin inserted into pin retainer 114 (labeled, for clarity, as pin retainer 114*b* in FIG. 1). Release 104 and base 106 are pivotally connected, as more clearly shown by FIGS. 5A and 7A & 7B. Such pivotal connection may be facilitated by pivot arms 508*a,b* which contact base at retaining flanges 602*a,b*. Lock 102 pivotally moves between an open position and a closed position. In the closed position, shown in greater detail in FIG. 8, grips 110 (labeled, for clarity, as grips 110*a,b* in FIG. 1) engage an implement (not shown in FIG. 1), facilitating retention of the implement via physical frictional contact. In the open position, shown in greater detail in FIG. 9, the grips 110 do not engage with the implement.

Movement from an open position to a close position is accomplished by applying pressure to lock 102 via thumb pad 120. Movement from a closed position to an open position is accomplished by applying pressure to release 104 via thumb pad 122. In some aspects, the pressure necessary to move from one position to another may be applied via a user's thumb, another finger, or another portion of the user's hand.

Lock 102 may retain an implement when in the closed position. Lock 102 includes one or more rigid portions and may include thumb pad 120. Thumb pad 120 is a rigid portion configured to be actuated by a user and cause lock 102 to pivot from an open position to a closed position. Thumb pad 120 may be ribbed, ridged, or have a rough texture in order to facilitate gripping and operation of lock 102. Such texturing also facilitates location of lock 102 by touch rather than sight, thus enabling operation of implement lock device 100 while the user is looking elsewhere. Thumb pad 120 may be a button, a portion of a lever, as shown in FIG. 1, a depressor, or another configuration apparent to those having skill in the relevant art(s) after considering the description herein.

Release 104 may be operated by applying pressure to release actuator 122. Operation of release actuator 122 causes release 104 to pivot and move lock 102 from the closed position to the open position via physical contact. Release actuator 122 may be ribbed, ridged, or have a rough texture in order to facilitate gripping and operation of release 104. Such texturing also facilitates location of release 104 by touch rather than sight, thus enabling movement of the implement lock device 100 while the user is looking elsewhere. In some aspects, the texture of release actuator 122 is distinct from the texture of thumb rest 120 in order to further facilitate operation of implement lock device 100 while the user is looking elsewhere. Release actuator 122 may be a button, a portion of a lever, as shown in FIG. 1, a depressor, or another configuration apparent to those having skill in the relevant art(s).

Base 106 is a rigid member and provides generally an outer cradle 113, located on an outer portion of implement lock assembly 100, for affixing to an implement holster 202. Base 106 has an inner wall 124, located on an inner portion of implement lock assembly 100, removably or permanently connects implement lock assembly 100 to other elements, as discussed in more detail with reference to FIG. 2, below. As shown in FIG. 1, inner wall 124 may be a planar member.

Additional elements may be attached to base 124 via one or more fasteners, adhesives, straps, pins, and the like. Wall 124 includes two spaced inner sockets 112 *a,b*, outer socket 116, and outer recess 118.

Inner sockets 112*a,b* are configured to receive t-nuts 1004 (see FIG. 11) inserted from the outer side of wall 124. Inner sockets 112 *a,b* are further configured to provide fasteners 1006 threadedly connected to t-nuts 100 (see FIG. 11).

Outer socket 116 and outer recess 118 receive a threaded fastener 110 inserted from the inner side of inner surface 124. The fastener 1010 is connected to a holster 202 positioned on the outer surface of base 106. Recess 118 may be a circular channel with depth equal to at least the height of a head of a fastener 1010, thereby enabling the fastener to be inserted into outer socket 116 without creating a protrusion along the inner side of inner surface 124 (see FIG. 10B).

Figure 2:
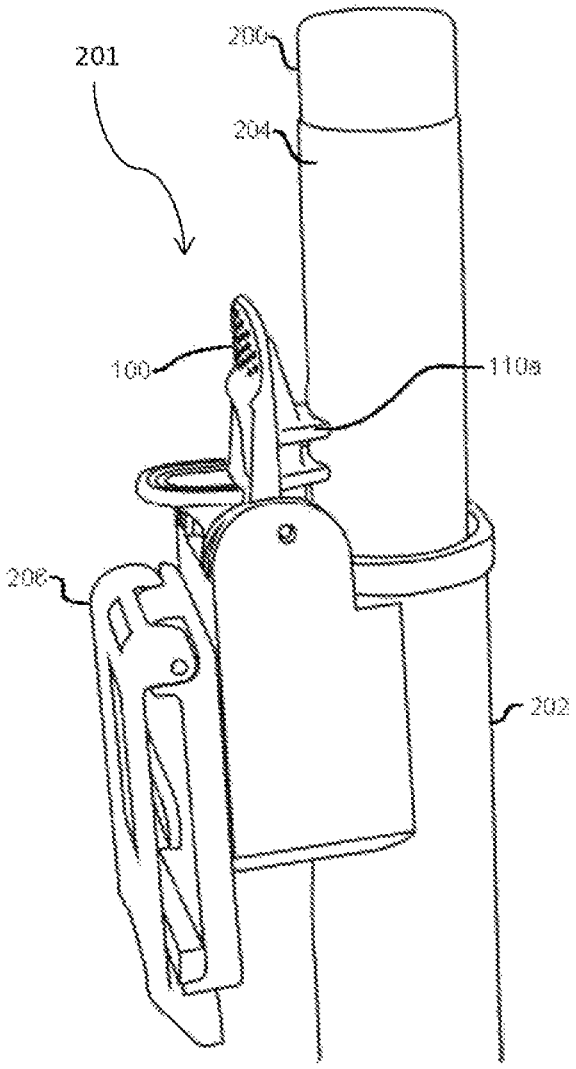
FIG. 2 is a side perspective view of an implement lock assembly including a holster, a belt clamp and an implement, showing the lock assembly engaged with the implement.

Referring now to perspective side view FIG. 2 of lock assembly 201 which shows a belt clamp or connector 206, implement lock 100, holster 202, and baton 200.

Belt connector 206 enables implement lock assembly 201 to be worn on a user's belt. Belt connector 206 may be a belt clip, a loop-type connection, a paddle or, as shown in FIG. 2, the belt clamp and carrier of U.S. Pat. No. 7,657,977, issued Feb. 9, 2010. As will be appreciated by those skilled in the relevant art(s) such implement lock assemblies 201 are not limited to usage with belts; the implement lock device 100 may be removably or permanently mounted on other suitable articles of clothing.

Lock devices 100 may be mounted on a variety or stationary and mobile surfaces such as a wall, or door, thereby enabling the implement lock device 100 to secure implements stored within attached holsters 202 even when not worn by an individual.

Implements, such as the baton 200 shown in FIG. 2, may be retained within holster 202 via physical contact with grips 110 (labeled, for clarity, only as grip 110*a* in FIG. 2). In some aspects, lock device 100 baton 200 is retained within holster 202 via pressure exerted upon the baton by grips 110. Retention of baton 200 may be further enhanced where baton 200 comprises a deformable baton grip 204. Baton grip 204 may be constructed of foam, rubber, or other resiliently deformable material. Grips 110 may be configured to push into and deform the baton grip 204 when implement lock device 100 is in a closed position, thereby enhancing retention power.

Figure 3A:
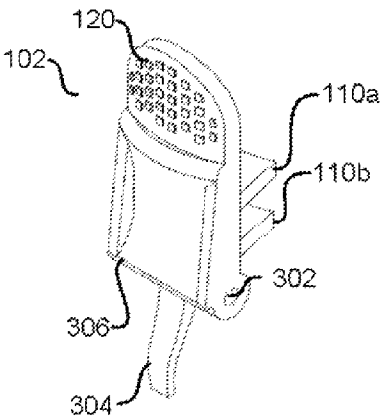
FIGS. 3A-3C are various views of a locking portion of an implement lock assembly.
Figure 3B:
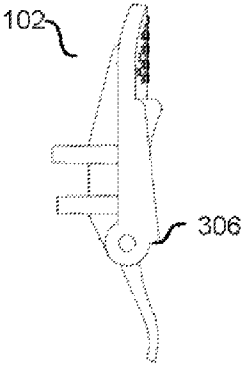
Figure 3C:
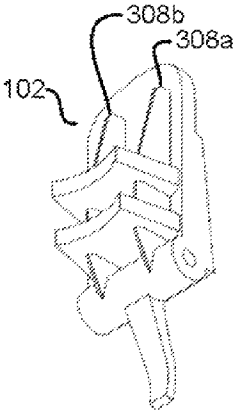

Referring now to FIGS. 3A-3C, various views of a portion of lock device 100, namely lock 102, in accordance with various aspects of the present disclosure, are shown. Lock 102 includes thumb pad 120, one or more grips 110*a* and 110*b*, reinforcing members 308*a*, and 308*b*, locking ridge 306, stabilizing spring tongue 304, and pivot pin housing 302.

When lock 102 is in the closed position, locking ridge 306 maintains lock 104 in a closed position via physical contact with release 104. In an aspect, locking ridge 306 is snap-fitted to a portion of release 104 when in the closed position, preventing movement of lock 102. Locking ridge may be an L-shaped rigid protrusion configured to contact release 104 only in the closed position.

One or more spaced reinforcing members 308 may be provided in order to stabilize grips 110 and increase durability of lock 102. Reinforcing members 308 are vertically oriented rigid beams which partially extend through horizontally oriented grips 110. This orientation provides increased rigidity and durability for various portions of lock 102 such as, thumb pad 120, pin housing 302, and grip 110.

Lock fulcrum includes pin housing 302, a horizontally-oriented passageway configured to receive a pivot pin 1002 (see FIG. 11), about which lock 102 pivots. Pin housing 302 is an elongated passageway designed to fit tightly around an inserted pin 1002. In another aspect, pin housing 302 may have a non-circular cross section and may be configured to facilitate pivoting of lock 102 in another manner which will be apparent to those having skill in the relevant art(s).

Stabilizing tongue 304 extends downward relative to thumb pad 120. Stabilizing tongue 304 preferably is formed of polymeric material and is resiliently tensioned to bias the lock in the open position. Stabilizing tongue 304 is configured to be physically contacted by a portion of release 104 when release 104 is being operated to move lock 102 from the closed position to the open position. Stabilizing tongue 304 is a thin, flat bar curved inwardly such that at least an end portion of stabilizing tongue 304 may be contacted by release 104. Stabilizing tongue 304 maintains lock 102 in an open position when implement lock device 100 is open via physical contact with a portion of release 104.

Figure 4A:
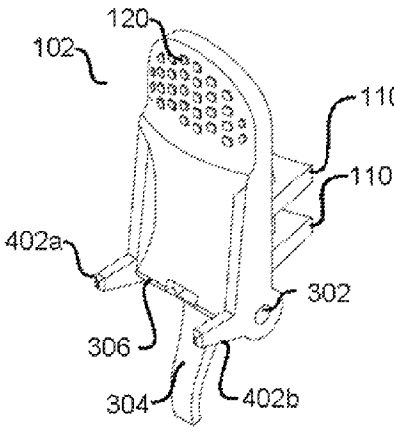
FIGS. 4A-4C are various views of an alternate embodiment of a locking portion an implement lock assembly.
Figure 4B:
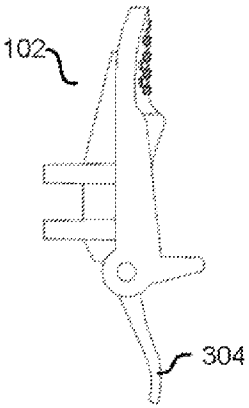
Figure 4C:
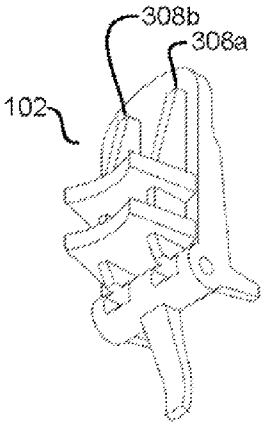

Referring now to FIGS. 4A-4C, various views of a portion of implement lock assembly 100, namely another aspect of lock 102. Lock 102 includes at least one pivot arm 402*a,b* is horizontally oriented and extends inwardly from lock 102 near pin housing 302. Pivot arm 402 is configured to be physically contacted by a portion of release 104 when release 104 is being operated to move lock 102 from the closed position to the open position. In an aspect, pivot arm 402 is positioned under release actuator 122 and is physically contacted by an underside portion of release actuator 122 during operation.

Figure 5C:
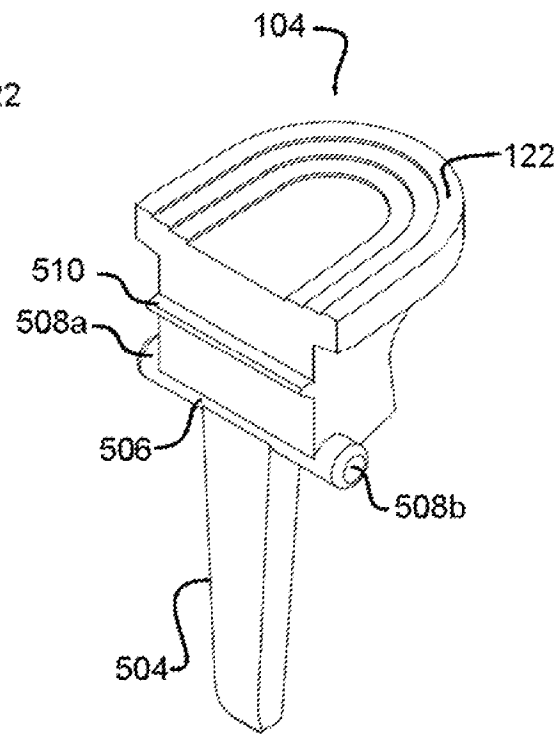
FIGS. 5A-5C are various views of a release actuator of an implement lock assembly.
Figure 5B:
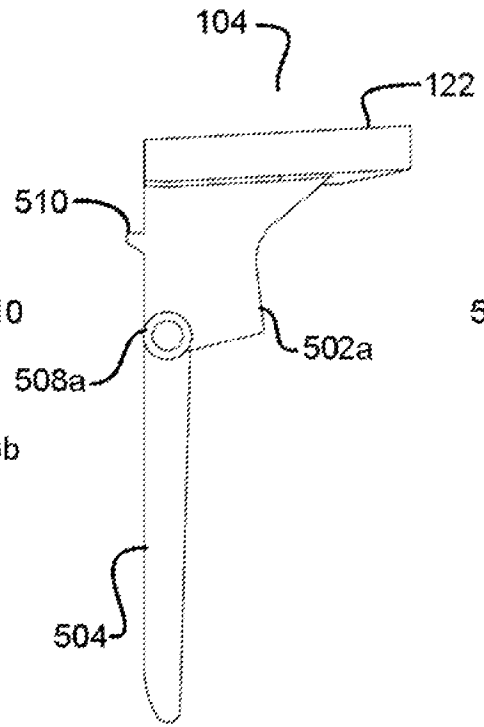
Figure 5A:
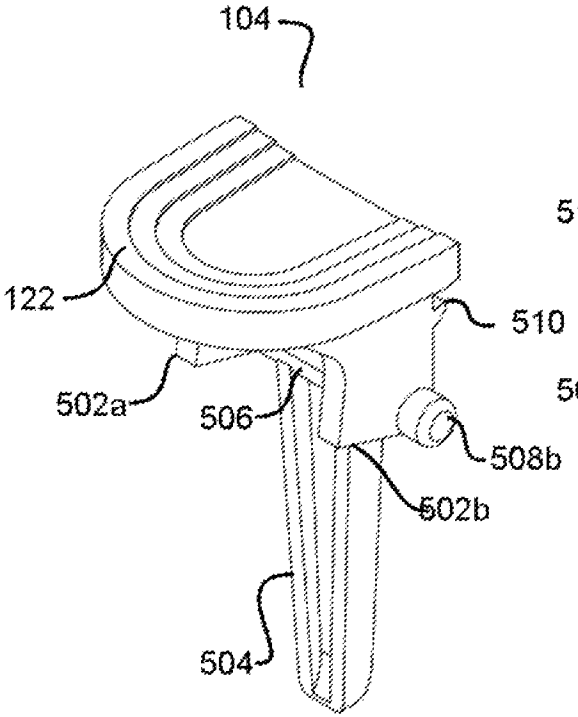

Referring now to FIGS. 5A-5C, various views of a portion of implement lock device 100, namely release 104 includes release actuator 122, one or more stops 502*a,b* in FIG. 5A, a tab 504, a release fulcrum 506, and a lip 510. Release 104 pivots about release fulcrum 506. Release fulcrum 506 is pivotably connected to base 106 at release fulcrum arms 508*a,b* in FIGS. 5A-C.

Release fulcrum 506 may be a cylindrical member configured to freely pivot, such rotation being constrained by other portions of release 104 contacting base 106. Release actuator 122 is positioned above release fulcrum 506. Downward force exerted on release actuator 122 causes release 104 to pivot about release fulcrum 506 in a clockwise direction with respect to the orientation depicted in FIG. 5B.

Tab 504 extends downward from release fulcrum 506 relative to release actuator 122. Tab 504 may be a flat polymeric tensioned member. Tab 504 is a spring-like resilient member, exerting a force when offset from its resting orientation. Tab 504 is configured to contact stabilizing tongue 304 when release 104 is being operated to move lock 102 from the closed position to the open position. In the open position, tab 504 is bent (as shown in more detail in FIG. 9B) and may physically contact stabilizing tongue 304, thereby maintaining implement lock device 100 in the open position.

Stop 502 is a vertically-oriented member having an angled bottom. Stop 502 is positioned under release actuator 122. The bottom portion of stop 502 is positioned such that it physically contacts a portion of base 106, thereby limiting movement of release 104. The angle of the bottom portion of stop 502 is chosen such that a substantial portion of the bottom portion of stop 502 physically contacts a portion of base 106 when release reaches a chosen pivot limit.

Lip 510 is configured to maintain lock 102 in the closed position when in contact with locking ridge 306. Lip 510 is a horizontally-oriented, L-shaped rigid member. When implement lock device 100 is in the closed position, locking ridge 306 and lip 510 are in physical contact. In an aspect, locking ridge 306 is snap-fitted to lip 510 when in the closed position. This contact prevents movement of lock 102. Lock 102 exerts a force against lip 510 which may cause release 104 to pivot in a counterclockwise direction with respect to FIG. 5B; however, tab 504 is positioned against an inner portion of inner surface 124 such that release 104 cannot pivot.

Figure 6A:
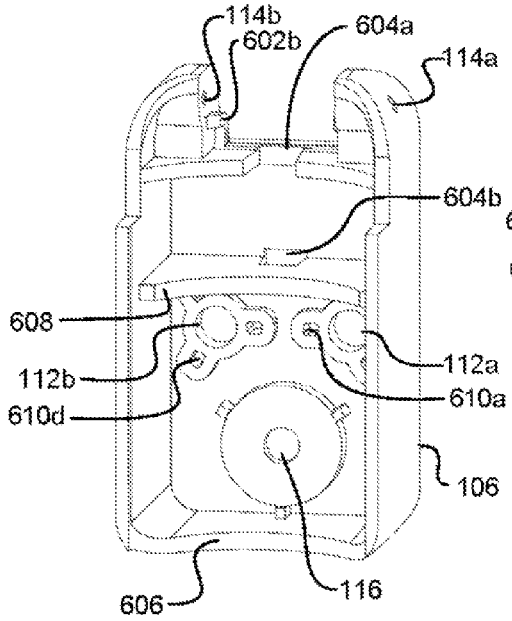
FIGS. 6A & 6B are various views of the base portion of FIG. 1.
Figure 6B:
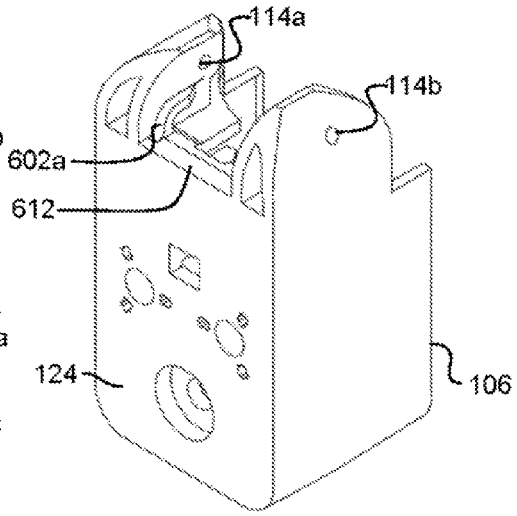

Referring now to FIGS. 6A & 6B, various views of a portion of implement lock device 100, namely the base 106 is shown most clearly. Base 106 has an outer surface 606, a cross-member 608, an inner surface 124, a base stop 612, one or more pin retainers 114*a,b*, one or more retaining flanges 602*a,b*, and one or more channels 604*a,b*.

Retaining flanges 602*a, b* are arcuate and nestingly receive fulcrum arms 508*a,b* below flanges 602*a,b* to movably connect to the base 106 at the top inner portion of base 106. At least one portion of release fulcrum 506 is slidably inserted into retaining flange 602 at release fulcrum arms 508. Release fulcrum arm 508*a* is slidably inserted beneath retaining flange 602*a* and release fulcrum arm 508*b* is slidably inserted beneath retaining flange 602*b*, thereby enabling release 104 to pivot within base 106.

Base stop 612 is a horizontally-oriented member positioned under retaining flange 602*a* and retaining flange 602*b*, forming a physical stop for release 104 and defining the pivot limit of release 104 in one direction.

Channel 604*a* is an opening in an upper portion of base 106 configured to allow insertion of tab 504 into base 106, and into channel 604*b* such that tab 504 may flex and contact an inner portion of inner surface 124, limiting pivoting of release 104 in a second direction.

Outer surface 606 conforms to a portion of holster 202 (not shown in FIG. 6) and may maintain the orientation of holster 202 and lock assembly 100, enabling implement lock 102 to retain implements inserted into holster 202 when lock 102 is in the closed position. Outer surface 606 may be a polymer formed to conform to the curved profile of an inner portion of holster 202. In another aspect, outer surface 606 may be a flexible gasket configured to conform to holster 202 and prevent debris from entering implement lock device 100 at the interface between outer surface 606 and holster 202. Such a gasket may also be configured to absorb shocks and other forces imparted on implement lock assembly 201.

Base 106 includes outer socket 116 and inner socket 112*a,b* in FIGS. 6A&B. Inner socket 112 may be the flange retainers 610*a,d* in FIG. 6A. Flange retainer 610 is an opening positioned to receive a flange of a t-nut inserted into inner socket 112 and to retain the tee nut.

Figure 7A:
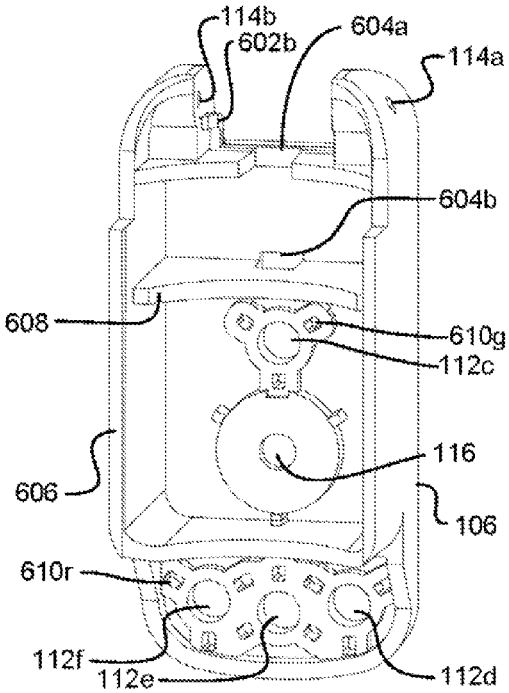
FIGS. 7A & 7B are various views of an alternate embodiment of the base portion.
Figure 7B:
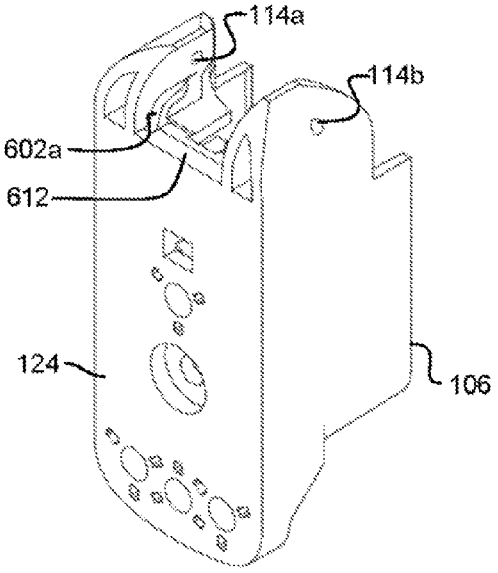

Referring now to FIGS. 7A & 7B, various views of the base of an alternate embodiment of the lock assembly 100 is shown. The configuration of portions of base 106, such as inner sockets 112 shown, for clarity, as inner socket 112*c-f* in FIGS. 7A&B, outer socket 116, outer surface 606 and inner surface 124, may be varied to interface with other portions of implement lock assembly 201. In an aspect where inner portion (e.g. a belt clip) of implement lock assembly 201 has an extended vertical profile or more stability, as desired, inner surface 124 may be longer than outer surface 606 and include additional inner sockets 112 so that the proper orientation of the holster may be oriented vertical, slanted forwardly or slanted rearward by selecting 112*c* and any of 112*d, e*, or *f*, as would be apparent to those having skill in the art(s).

Figure 8A:
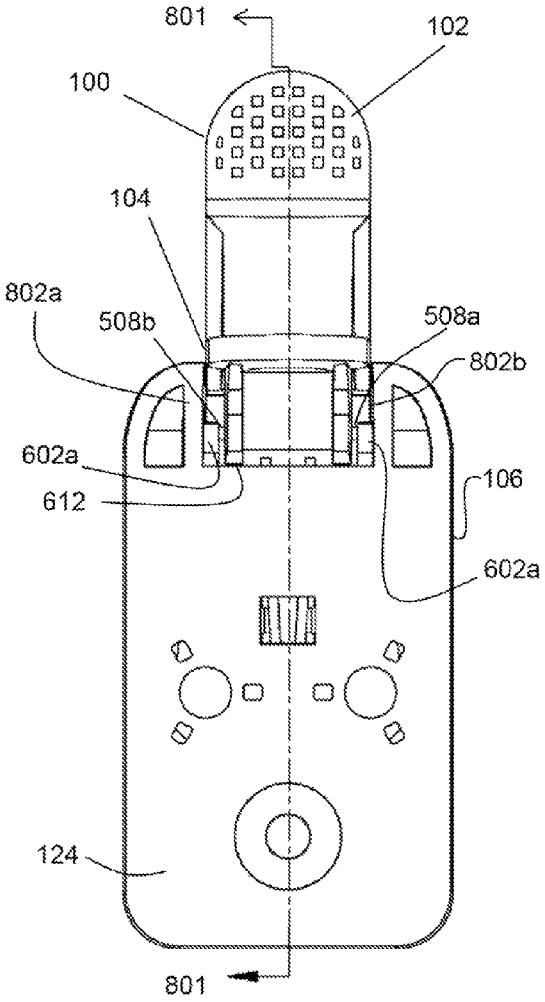
FIGS. 8A & 8B respectively are a rear view and a cutaway view of an implement lock assembly in the closed position.
Figure 8B:
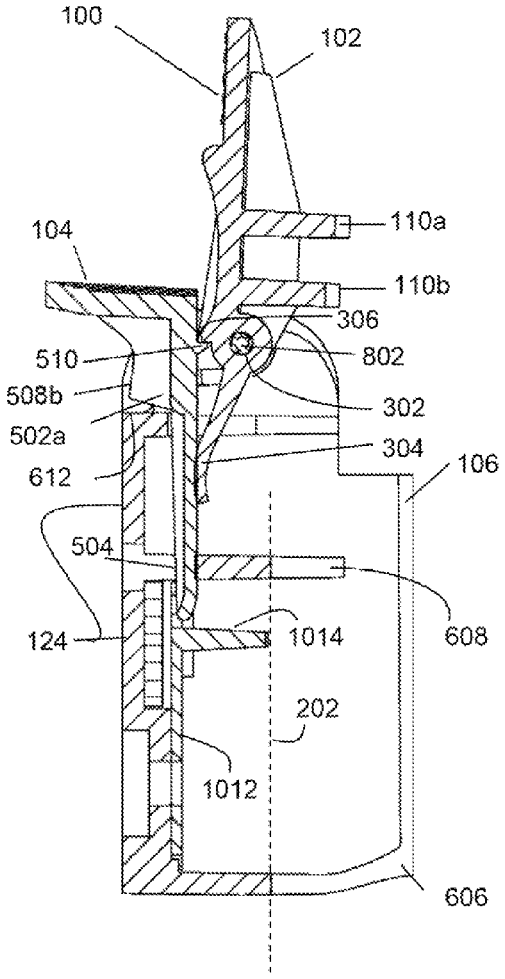

Referring now to FIGS. 8A & 8B, a rear view and a cutaway view of implement lock device 100, wherein the lock device 100 is in the closed position, in accordance with various aspects of the present disclosure, are shown.

Figure 11:
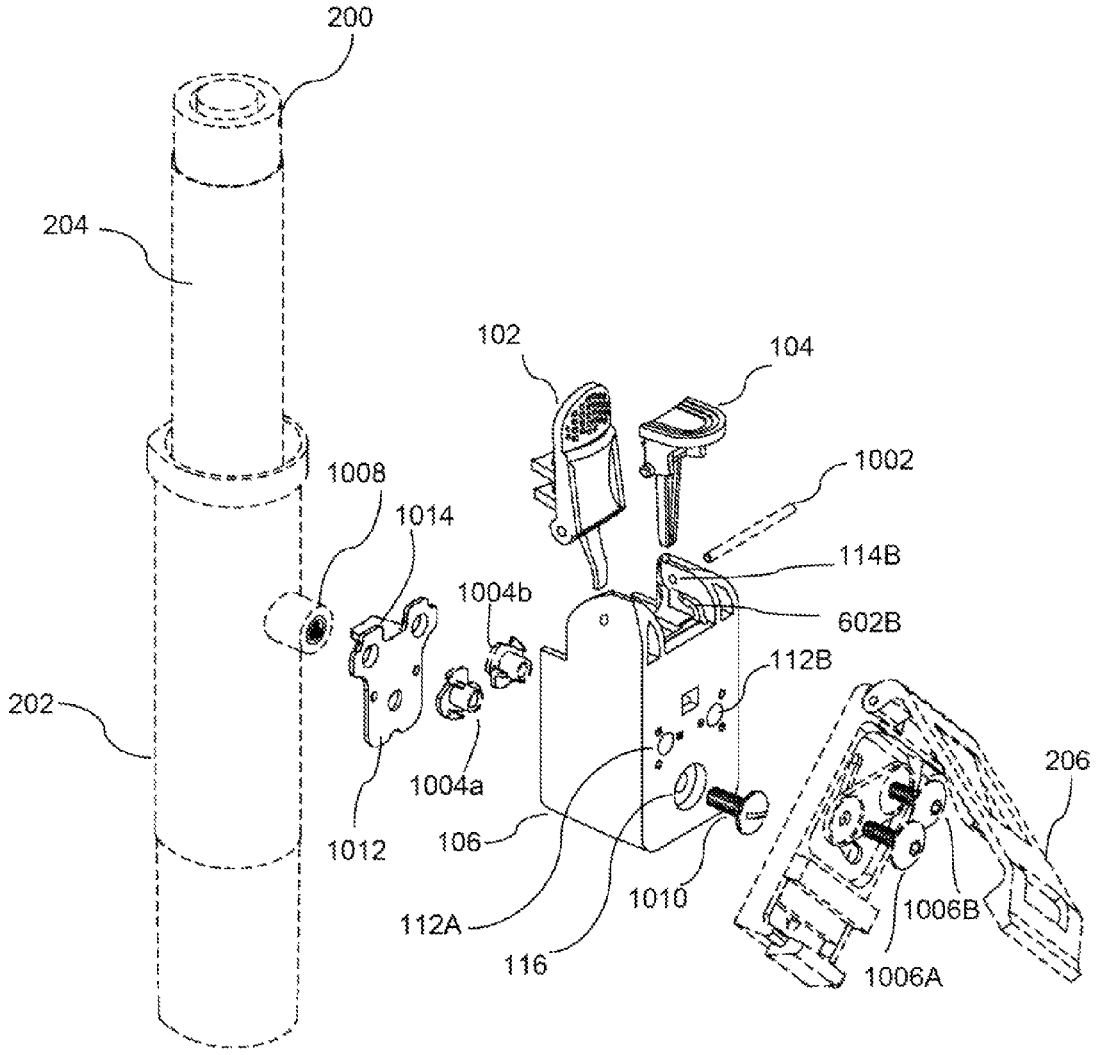
FIG. 11 isometric exploded view of the implement lock assembly with the belt clamp, the holster and the baton shown in broken lines.

FIG. 8B depicts a cutaway view of lock device 100 along cut line 801 of FIG. 8A. A t-nut retainer 1012 (shown more clearly in FIG. 11) is a planar member generally in the inner form of the cavity in the base 106, as seen in FIG. 6A, and this retainer 1012 is forced into the cavity to retain the t-nuts 1004*a,b* in place when the base is removed from the holster 202. Also the retainer 1012 has a leg 1014 at its upper end portion which engages at the leg free end with the holster 202 when the base 106 is attached to holster, as represented by the vertical broken line. Retainer 1012 need not overlie the entire faces of the t-nuts 1004*a,b* to be effective in the retention of the t-nuts. As shown in FIG. 11, bolt connector 1010 passes through the retainer plate 1012 before being threadedly connected to retainer mount 1008 of the holster 202.

In the closed position, locking ridge 202 is nested or caged by the closely fitted walls 802 (labeled, for clarity, as walls 802*a, b* in FIG. 8A) of base 106 and release 104. Locking ridge is snap-fitted to lip 510, preventing movement of lock 102. Stabilizing tongue 304 may contact tab 504. Tab 504 is in an untensioned orientation. Grip 110 is positioned such that grip 110 will apply a retaining pressure against a portion of an implement, such as baton 200.

Figure 9A:
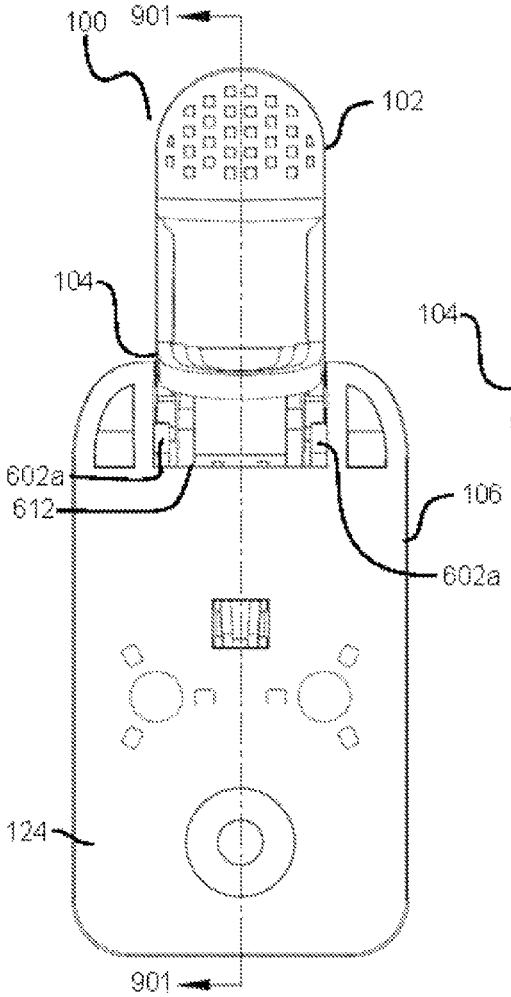
FIGS. 9A & 9B respectively are a rear view and a cutaway view of an implement lock assembly with the implement lock assembly in the open position.
Figure 9B:
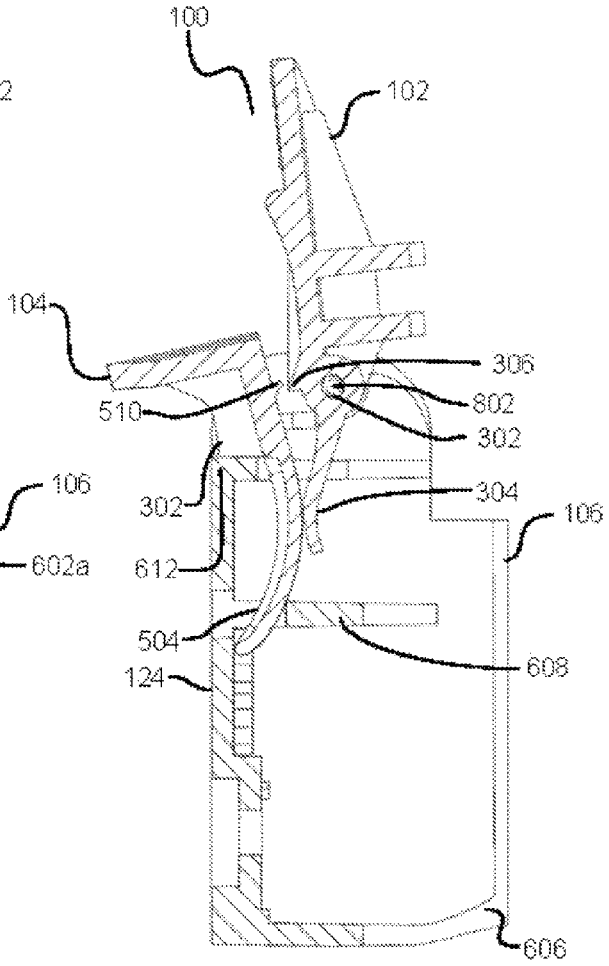

Referring now to FIGS. 9A & 9B, a rear view and a cutaway view of implement lock device 100, wherein the implement lock device 100 is in the open position, in accordance with various aspects of the present disclosure, are shown.

FIG. 9B depicts a cutaway view of lock device 100 along cut line 901 of FIG. 9A.

In the open position, locking ridge 306 and lip 510 are disengaged. When disengaged, lock 102 cannot apply a retaining pressure against a portion of an implement, or otherwise retain an implement holstered in lock assembly 201, enabling the implement to be readily removed or inserted into holster 202.

Tab 504 is in a curved, tensioned position. Via such a curved position, tab 504 may maintain lock 102 in an open position via physical contact with stabilizing tongue 304. Tension contained in tab 504 when tab is in the position depicted in FIG. 9B may facilitate returning release 104 and lock 102 to the closed position because, when released, tab 504 functions as a spring returning to its resting condition and exerts a rotational force on release 104. Tab 504 may be held in the open position depicted in FIG. 9A via user manipulation or via the position of lock 102.

Figure 10A:
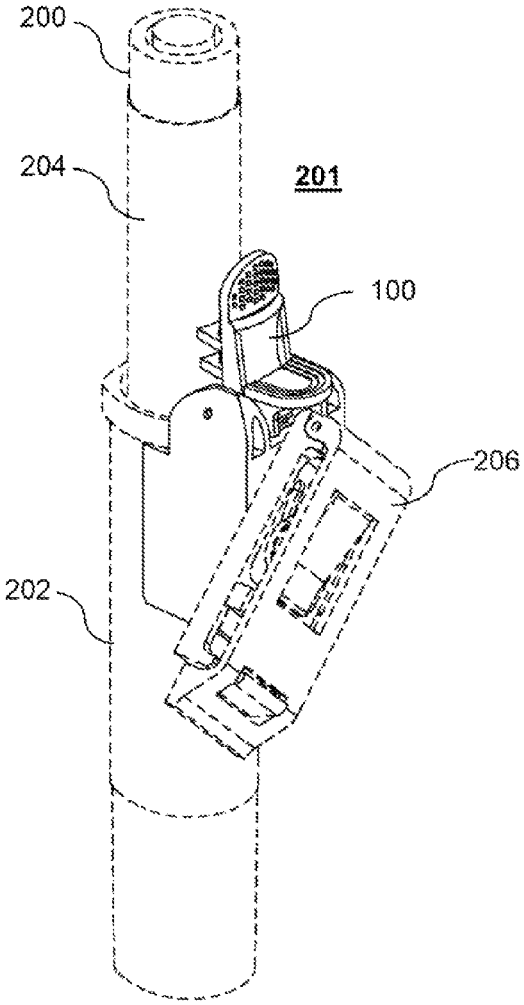
FIGS. 10A & 10B are various views of an implement lock device showing the interrelationship of portions of the implement lock assembly including a belt clamp, holster, and baton.
Figure 10B:
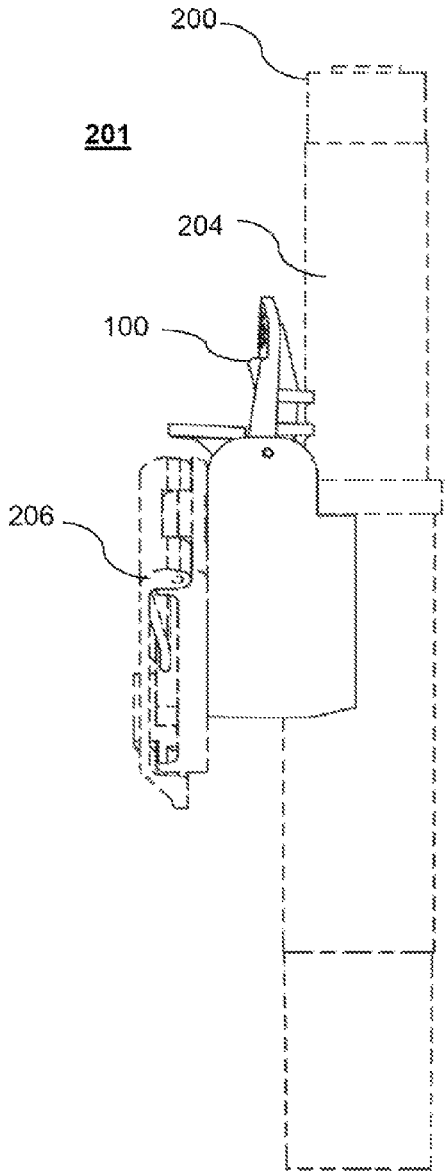

FIGS. 10A & 10B, various views of implement lock device 100 showing the interrelationship of portions of implement lock assembly 201 including belt clamp 204, lock device 100, holster 202, and baton 200, in accordance with various aspects of the present disclosure.

Pin 1002 is inserted into horizontally-oriented pin retainer 114 (labeled, for clarity, only as pin retainer 114*a* in FIG. 11) and lock pin housing 302, forming pin hinge 108 (for clarity, not labeled in FIGS. 10A,B), about which lock 102 pivots.

Belt clamp 206 is attached to implement lock device 100 at inner sockets 112*a,b* in FIG. 11). T-nuts 1004*a,b* are respectively inserted into inner socket 112*a,b* from the outer side of inner surface 124. Connectors 1006*a, b* are inserted through a portion of belt clamp 204 and inserted into T-nuts 1004*a,b*, connecting belt clamp 206 and lock assembly 100. Interior portions of T-nuts 1004*a,b* and exterior portions of connectors 1006*a,b* are threaded, enabling them to be screwed into T-nuts 1004*a, b*.

Holster 202 is attached to lock assembly 100 at outer socket 116. Holster 202 has an external retainer mount 1008 that aligns with socket 116. Retainer mount 1008 includes a threaded interior portion, enabling the removable connector 1010 to fix the assembly 100 to the holster 202. Connector 1010 is inserted into outer socket 116 from the inner side of inner surface 124 and screwed into retainer mount 1008, with the T-nut retainer 1012 positioned between retainer mount 1008 and outer socket 116. If desired a washer may be used in lieu of retainer 1012 if one did not wish to have the features provided by the retainer 1012.

Implement lock assembly 201 is usually worn on an individual's belt, with a gap form between holster 202 and the user. Lock 102 and release 104 are located in this gap and are therefore somewhat protected from activation by unauthorized third parties seeking to remove the implement held in holster 202, such as baton 200, reducing the likelihood of unauthorized removal.

In order for a user to remove baton 200 from implement lock assembly 201, the following actions occur. First, the user grips baton 200 and, with the thumb or other finger of the gripping hand, the user actuates release actuator 122, causing lock 102 to move from the closed position to the open position. Second, the user maintains his grip on the baton and pulls it out of the holster 202.

While various aspects of the present disclosure have been described above, it should be understood that they have been presented by way of example and not limitation. It will be apparent to persons skilled in the relevant art(s) that various changes in form and detail can be made without departing from the spirit and scope of the present disclosure. The present disclosure should not be limited by any of the above described aspects, but should be defined only in accordance with the following claims and their equivalents.

What is claimed is:

1. An implement lock assembly comprising:

a base having an outer surface for receiving a holster;

a lock pivotable between a closed position and an open position about a lock fulcrum, the lock fulcrum being pivotally connected to the base;

a thumb rest positioned above the lock fulcrum and actuatable by a user to pivot from the open position to the closed position;

a stabilizing tongue positioned below the lock fulcrum and contacted by a portion of a release to facilitate pivoting of the lock from the closed position to the open position when the release is actuated by the user;

a locking ridge releasably engaging the release when in the closed position;

a grip engaging and retaining an implement positioned within the holster when the lock is in the closed position;

the release being pivotably connected to the base and pivotable between a closed position and an open position about the release fulcrum, the release fulcrum being pivotably connected to the base;

a release actuator positioned above the release fulcrum and actuatable by the user to pivot from the closed position to the open position;

a tab positioned below the release fulcrum and contacting the stabilizing tongue and to facilitate pivoting of the lock from the closed position to the open position when the release is actuated by the user;

a lip releasably connecting the lock and the release at the locking ridge when the lock is in the closed position, the lip being separable from the locking ridge via actuation of the release actuator by the user; and the lock when in the open position being clear of the holster so as not impede the insertion or removal of an implement within the holster.

2. The implement lock assembly of claim 1, wherein, when the lock is in the closed position, the grip physically contacts the implement when positioned within the holster and retains the implement via physical pressure.

3. The implement lock assembly of claim 1, wherein the lock fulcrum further includes a pin housing being horizontally oriented and receiving a pin;

the base further includes a first pin retainer and a second pin retainer, the first pin retainer and the second pin retainer being formed to slidably receive the pin inserted into the first pin retainer, the pin housing, and the second pin retainer, and pivotably connecting the lock to the base; and a pair of retaining flanges positioned to respectively receive the release fulcrum at release fulcrum arms, each retaining flange being configured as a arcuate member to pivotably connect the base to the release.

4. The implement lock assembly of claim 1, the base further including an inner surface vertically oriented within the pivotal path of the release, for limiting the pivoting of the release in a first direction via physical contact with the tab; and a base stop horizontally oriented above the inner surface within the pivoting path of the release for limiting the release in a second direction via physical contact with a stop, the stop being positioned on a bottom portion of the release actuator.

5. The implement lock assembly of claim 1, the base further including a vertically oriented inner surface formed into an inner socket for connecting the implement lock device to a first element, the first element contacting the inner surface; and an outer socket for connecting the implement lock assembly to the holster, the holster contacting the outer surface.

6. The implement lock assembly of claim 1, wherein the holster is an elongated cylindrical member having an inner surface, and the outer surface of the implement having a convex curvature for nestingly contacting the inner surface of the holster.

7. The implement lock assembly of claim 1, wherein the release actuator is horizontally oriented and positioned inward and below the thumb rest.

8. The implement lock assembly of claim 1, wherein the thumb rest is vertically oriented and positioned outward and above the release actuator.

9. The implement lock assembly of claim 1, wherein the tab is a vertically oriented polymeric tensioned tab that is bent and under tension in the open position, the tab contacting the stabilizing tongue to maintain the lock device in the open position, and the tab facilitates the return of the implement lock device to the closed position via conversion of the tension of the tab into a pivotal force exerted on the release.

10. The implement lock assembly of claim 1, further comprising a t-nut retainer in the base for retaining a pair of t-nuts in the housing when a belt clamp is disconnected from the base at the outer surface.

11. The implement lock assembly of claim 1, wherein the lock assembly is connected to an inner portion of the holster at an outer surface of the base, an inner surface of the base configured to be positioned proximally to a user, and the lock and the release configured to be spacedly located between the holster and the user.

12. The implement lock assembly of claim 11, further including a belt attachment mounted to the base outer surface by a pair of spaced t-nuts within the base and a pair of connectors passing into the base and respectively engaging the t-nuts, a t-nut retainer press fit in the base to maintain the t-nuts in place when the connectors are disconnected from the t-nuts.

13. The implement lock assembly of claim 1, wherein the holster is vertically oriented and receives a baton, a baton grip portion of the baton being exposed when baton is in the holster, and the lock is configured to retain the baton by exerting a physical pressure against the baton grip when the lock is in the closed position.

14. The implement lock assembly of claim 13, wherein the baton grip is constructed of a resiliently deformable material.

15. The implement lock assembly of claim 13, wherein a portion of the baton grip is positioned above the implement lock when the baton is retained by the implement lock.

16. The implement lock assembly of claim 15, wherein the portion of the baton grip positioned above the implement lock device when the baton is retained by the implement lock is selectively adjustable.

17. The implement lock assembly of claim 16, wherein adjustment of the portion of the baton grip positioned above the implement lock is facilitated by physically contacting the baton grip with the lock at different vertical positions of the baton grip when the lock is in the closed position.

18. The implement lock assembly of claim 1, wherein the implement is one of: a baton, a nightstick, a hammer, a screwdriver, a wrench, a knife, a multitool, an electronic device, an electroshock weapon, handcuffs, a firearm, and pepper spray.

19. An implement lock assembly comprising:

a lock configured to pivot between a closed position and an open position;

the lock including a lock fulcrum, the lock fulcrum being pivotally connected to the base, the lock fulcrum including a pin housing being horizontally-oriented for receiving a pin;

a thumb rest positioned above the lock fulcrum and configured to be actuated by a user and to cause the lock to pivot from, the open position to the closed position;

a stabilizing tongue positioned below the lock fulcrum and contacted by a portion of a release and facilitate lock pivoting from the closed position to the open position when the release is actuated by the user;

a locking ridge releasably connecting the lock and the release when in the closed position; and a grip to retain a baton positioned within the holster when the lock is in the closed position;

a release pivotally connected to the base and pivoting between a closed position and an open position about a release fulcrum, the release fulcrum pivotally connected to the base;

a release actuator positioned above the release fulcrum and actuatable by the user to cause the lock to pivot from the closed position to the open position;

a tab positioned below the release fulcrum and for contacting the stabilizing tongue and facilitate lock pivoting from the closed position to the open position when the release is actuated by the user;

a lip releasably connecting the lock and the release at the locking ridge when the lock is in the closed position, the lip being separable from the locking ridge via actuation of the release actuator by the user; and a base configured to receive a holster at an outer surface;

the base including a first pin retainer and a spaced second pin retainer, the first pin retainer and the second pin retainer slidably receiving a pivot pin inserted into the first pin retainer, the pin housing, and the second pin housing, and pivotally connecting the lock to the base;

a pair of spaced retaining flanges positioned to receive the release fulcrum at release fulcrum arms, each retaining flange being an arcuate member connecting the base to the release;

an inner surface vertically-oriented within the pivoting path of the release to limit the pivoting of the release in a first pivotal direction via physical contact with the tab; and a base stop horizontally-oriented above the inner surface within the pivotal path of the release to limit pivoting of the release in a second pivotal direction via physical contact with the stop, the stop being positioned on a bottom portion of the release actuator.

* * * * *